US008347562B2

(12) United States Patent
Morris et al.

(10) Patent No.: US 8,347,562 B2
(45) Date of Patent: Jan. 8, 2013

(54) RADIANT BARRIER RAFTER VENT

(76) Inventors: Kevin D. Morris, Lewisport, KY (US); Adam D. Morris, Lewisport, KY (US)

( * ) Notice: Subject to any disclaimer, the term of this patent is extended or adjusted under 35 U.S.C. 154(b) by 208 days.

(21) Appl. No.: 12/798,383

(22) Filed: Apr. 2, 2010

(65) Prior Publication Data

US 2011/0239574 A1 Oct. 6, 2011

(51) Int. Cl.
*E04D 13/00* (2006.01)
*E04D 3/40* (2006.01)
*E04B 7/00* (2006.01)

(52) U.S. Cl. ..... 52/95; 52/198; 52/199; 52/407.3; 52/407.5; 52/408; 428/182; 428/163; 428/167

(58) Field of Classification Search ..... 52/407.3, 52/406.2, 406.1, 407.5, 404.1, 407.4, 506.01, 52/506.03, 506.04, 506.06, 506.08, 506.09, 52/506.1, 92.1, 95, 99, 199, 198; 273/70; 428/172, 192, 77, 182, 184, 167, 163; 454/365, 454/260; 126/621
See application file for complete search history.

(56) References Cited

U.S. PATENT DOCUMENTS 2,782,914 A * 2/1957 Giles ..... 428/101
3,967,430 A * 7/1976 Knudson ..... 52/745.07
4,047,345 A * 9/1977 Alderman ..... 52/404.1
4,318,260 A 3/1982 Siegel et al.
4,346,544 A 8/1982 Larssen
4,704,312 A * 11/1987 Butcher ..... 428/12
5,058,352 A * 10/1991 Loiselle et al. ..... 52/404.2
5,085,023 A 2/1992 Duffy
5,357,722 A 10/1994 Kessler
5,561,959 A * 10/1996 Alderman et al. ..... 52/407.3
5,564,250 A 10/1996 Kessler
5,596,847 A * 1/1997 Stephenson ..... 52/198
5,724,780 A 3/1998 Bolich
5,918,436 A 7/1999 Alderman
6,061,973 A * 5/2000 Accardi et al. ..... 52/90.1
6,083,603 A 7/2000 Patel et al.
6,444,286 B1 9/2002 MacKenzie
6,557,313 B1 5/2003 Alderman
6,797,356 B2 9/2004 Zupon et al.
6,832,460 B2 12/2004 Fligg
6,857,238 B2 2/2005 Alderman
6,901,711 B2 6/2005 Fay et al.
7,404,271 B2 7/2008 Kersbergen
7,818,922 B2 * 10/2010 Ellis ..... 52/95
2004/0000113 A1 1/2004 Alderman
2004/0163345 A1 8/2004 Alderman
2004/0250490 A1 12/2004 Hall
2005/0229504 A1 10/2005 Bennett et al.
2007/0181704 A1 8/2007 Ernst
2007/0259155 A1 11/2007 Zupon et al.
2008/0000181 A1 1/2008 Sillik
2008/0110123 A1 5/2008 Oberoi et al.
2008/0134608 A1 6/2008 Snyder
2009/0021176 A1 1/2009 Bennet et al.
2009/0061147 A1 3/2009 Lippy et al.

* cited by examiner

*Primary Examiner* — William V Gilbert
*Assistant Examiner* — Chi Q Nguyen
(74) *Attorney, Agent, or Firm* — Carrithers Law Office PLLC; David W. Carrithers

(57) ABSTRACT

A radiant barrier rafter vent defining an elongate radiant heat reflective panel formed from a sheet of aluminum or other heat reflective material having longitudinal creases that permit compressing the panel a selected amount in a direction transverse to its length and panel strengthening spaced apart formations on the remainder of the panel. The panel have a high reflectivity and are installable in various buildings between the rafters or roof supports spaced apart from the roof and optionally coated with a sound absorbing material or include small perforations therein.

20 Claims, 5 Drawing Sheets

RADIANT BARRIER RAFTER VENT

FIELD OF INVENTION

The present invention generally relates to insulation for buildings and, more particularly, to insulation members designed to reflect radiant heat energy. More particularly the present invention is directed to a radiant heat reflective panel formed so as to be insertable in press fit relation between adjacently disposed roof rafters in a ventilated attic of a building. The radiant barrier may be used with or without traditional bulk insulation.

BACKGROUND OF INVENTION

Radiant barriers are installed in buildings to reduce summer heat gain and winter heat loss, and hence to reduce building heating and cooling energy usage. The potential benefit of attic radiant barriers is primarily in reducing air-conditioning cooling loads in warm or hot climates. Most of the known radiant barriers are composite members consisting of a thin sheet or coating of a highly reflective material, such as aluminum, applied to one or both of opposite face surfaces of a suitable substrate material. The substrate maybe kraft paper, plastic films, cardboard, or the like. Some products are fiber reinforced to increase the durability and/or stiffness. The reflective panel may also be comprised in whole or in part of a plastic, paper, or corrugated sheet of material covered by a reflective material such as aluminum or other metal foil or even a reflective coating such as a metallic paint.

Radiant barriers work by reducing heat transfer by thermal radiation across the air space between the roof deck and the attic floor and may be installed in attics in several configurations. The simplest method of application is to lay the radiant barrier directly on top of existing attic insulation, with the reflective side up. Another way is to attach it near the roof and a still further way is to drape the radiant barrier over the tops of the rafters before the roof deck is applied. Another variation is to attach the radiant barrier directly to the underside of the roof deck.

The following references, directed to reflective insulation panels, rafter vents, radiant barriers and the like reference, are considered to be only of interest: U.S. Patent Publication 2008/0134608 by Snyder published Jun. 12, 2008 Snyder; U.S. Patent Publication 2007/0259155 by Zupon et al. published Nov. 8, 2007; U.S. Pat. No. 7,302,776 by Duncan et al. granted Dec. 4, 2007; U.S. Pat. No. 6,926,785 by Tanzer et al. granted on Aug. 9, 2005; U.S. Pat. No. 6,800,352 by Hejna et al. granted Oct. 5, 2004; U.S. Pat. No. 6,444,286 by MacKenzie granted Sep. 3, 2002; and U.S. Pat. No. 6,346,040 granted on Feb. 12, 2002.

In residential homes typically the roof structure is formed of materials which inherently have minimal thermal insulating and emissivity barrier properties. Therefore, heat transfer through the roof structure from the outdoors to the interior space of for example, a home, particularly during the summer months, is a problem to the home owner. Either the home owner undergoes severe discomfort due to the elevated temperatures inside the house or they must pay a high price for utilities including installation and operation of an air conditioning system. The insulating solar or heat emitting properties of a structural roof have undergone limited improvements. Excess heat transfer is generated on a daily basis at least in the summer months penetrating into the interior of building materials such as sheet rock and insulation and cause unwanted elevated temperatures within the interior living space. Thus under conventional home construction conditions, the air temperature in attics and ceilings can be raised to about 140 degrees F. or higher.

SUMMARY OF INVENTION

With an increasing emphasis on energy efficiency and "green" building materials, the combination of a radiant barrier and rafter vent is the solution.

The radiant barrier rafter vent ("RBRV"), can be produced from recycled aluminum material and have the ability to be 100 percent recyclable. The foil or sheet reflects and/or limits a substantial amount of the radiant energy from passing through the barrier. The reflective metal foil utilized in at least one preferred embodiment of the invention is composed of a non petroleum product and is environmentally friendlier than foam, plastic, paper, or most other man made materials.

Addition of the radiant barrier rafter vent under the roof deck after construction eliminates the inherent problem with moisture from rain on the roof decking during construction by allowing air circulation from the soffit to the ridge via the air cavity between the vent and roof deck after construction. Radiant barriers are recommended to be installed in buildings by: RIMA International, Rocky Mountain Institute, Florida Solar Energy Center, and the Department of Energy. A radiant barrier installed in a home's roof deck is southern climates is among the top energy saving items to be considered into today's energy saving projects.

The present invention comprises, consists essentially of, or consists of a heat reflective elongate panel insertable in friction fit between adjacently disposed spaced apart roof rafters and/or held in position with lateral support wires in cooperative engagement with the rafters, the panel having first and second laterally spaced apart longitudinally extending creased sections and panel strengthening formations disposed there between, the creased sections being disposed adjacent respective opposite longitudinal marginal edges of the panel permitting compressing the same a selected amount in a direction transverse to its length and wherein the panel longitudinal marginal edges are formed into panel strengthening ribs.

More particularly, the present invention comprises, consists essentially of, or consists of: an elongate radiant heat reflective panel of a flexible material such as a paper, plastic, metal or other pliable material having a heat reflective surface for instance such as chrome or aluminum. One preferred material is a sheet of aluminum of a selected thickness having longitudinal creases formed on selected portions thereof permitting compressing the panel a selected amount in a direction transverse to its length and panel stiffening protrusions spaced apart from one another on the remainder of the panel. The panel may include creases located proximate each of opposite longitudinal edges of the panel. Moreover, the protrusions can include a major rib extending transversely across the panel from one to the other of the creases at a position proximate each of opposite ends of the panel. A plurality of minor spaced apart ribs can be located between the major ribs and opposite longitudinal edges of the panel can be folded over providing stiffening ribs. The marginal edge stiffening ribs of the panel can be tubular and the panel can utilize major ribs having a narrow groove in each of opposite ends thereof. The panel can include a curved springy wire for each of the major ribs, the wires having opposite end portions thereof nested in the narrow grooves of the major rib associated therewith and piercing through the longitudinal creases. Creases provide accordion-like parallel pleated sections spaced apart from one another in a direction transverse to the length of the panel.

An object of the present invention is to provide a radiant heat reflective panel that is insertable in press fit relation between roof rafters of a building and/or be held in position or reinforced with a lateral wire extending there through (preferably within a groove formed therein) for locking the panel in place in a selected position between the rafters spaced apart from the roof.

A further object of the present invention is to provide a heat reflective panel of relatively thin aluminum sheet formed to provide suitable rigidity and including longitudinal creases compressible in a direction transverse to the length of the panel.

It is another object of the present invention to provide a panel including a plurality of small holes formed therein providing ventilation and sound deadening features.

Is another object of the invention to provide a coating on the underside of the panel to provide a sound deadening effect.

It is another object of the present invention to optionally provide a coating of paper, corrugated material, foam, dense foam, cellular material or combinations thereof to aid in insulation and/or to produce a sound deadening effect.

In keeping with the forgoing there is provided in accordance with the present invention an elongate radiant heat reflective panel comprising a sheet of aluminum of selected minimum thickness formed to provide longitudinal creases on selected portions thereof permitting compressing the panel a selected amount in a direction transverse to its length and protrusions spaced apart from one another stiffening the remainder of the panel. The creases are disposed preferably proximate opposite longitudinal marginal edges of the panel and the protrusions disposed there between. In the preferred form the protrusions are ribs. The panels are insertable in press fit relation between the roof rafters and preferably secured via curved springy wires that space the panel a preselected distance from the roof decking.

At least one preferred embodiment comprises, consists essentially of and/or consists of a radiant barrier panel having an elongated heat reflective sheet of reflective material of selected thickness having longitudinal creases formed on selected portions thereof permitting compressing the panel a selected amount in a direction transverse to its length and panel stiffening protrusions spaced apart from one another on the remainder of the panel including at least one longitudinal lateral support member cooperatively engaging and removably holding said sheet in a selected position disposed between a pair of roof support members spaced apart from a roof a selected distance.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the several views and wherein.

DETAILED DESCRIPTION OF THE PREFERRED EMBODIMENT

Figure 2:
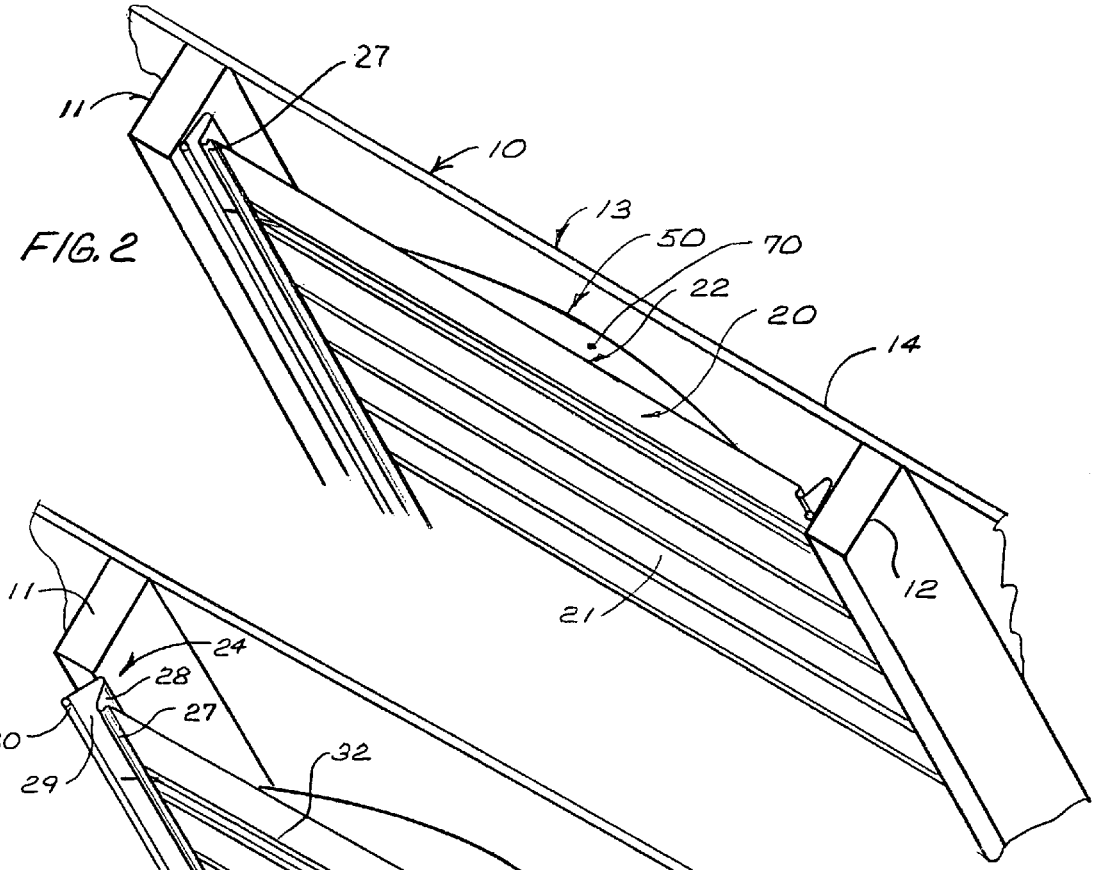
FIG. 2 in an oblique view showing a portion of some components of a truss roof structure and a radiant heat reflective panel provided in accordance with one aspect of the present invention and secured by an anchoring means in accordance with another aspect of the present invention.
Figure 1:
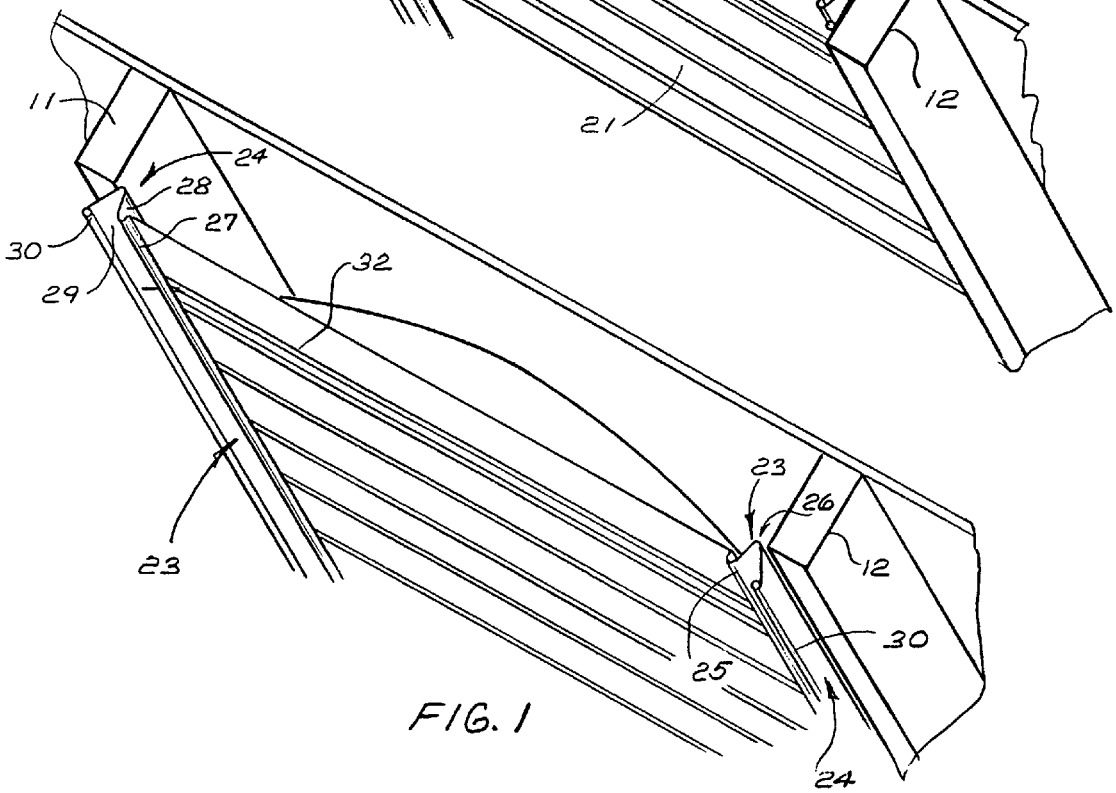
FIG. 1 is an oblique view of the device showing a portion of some components of a truss roof structure but with the radiant heat reflective panel in accordance with one aspect of the present invention just prior to being inserted between the two adjacently disposed roof rafters.
Figure 3:
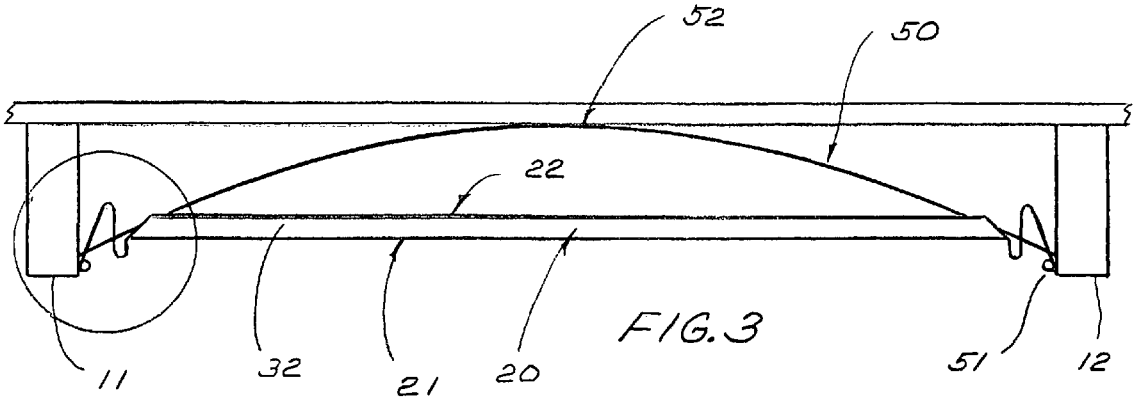
FIG. 3 is essentially an end view of FIG. 2.

In FIGS. 1 & 2 there is illustrated a few components of a portion of a building roof structure 10 of wood construction that includes parallel, adjacently disposed, roof rafters 11, 12 covered over with and supporting sheeting material 13 such as plywood, OSB (oriented strand board) or the like. The outer surface 14 of the sheeting material, in a completed building, would have a weather proof covering consisting of tiles, shingles, sheet metal roofing or the like overlying a lapped layer of tar paper non of which for reasons of simplicity is shown. In a conventional residential building having a roof of wood construction the roof rafters are spaced 16 inches unless constructed using trusses, wooden J-joints, conventional rafters or any other rafter frame utilizing spaced apart longitudinal members to support the roof, which can be for example 24 inches center-to-center. In the embodiment illustrated the spacing assumed is 24 inches in which case the distance between the faces of adjacent roof rafters is 22.5 inches. It is contemplated that the invention can be fabricated to fit between rafters of any width.

A panel 20, provided in accordance with a principal aspect of the present invention, is shown generally in FIGS. 1 to 5. In FIG. 1 the panel 20 is shown just prior to being inserted between the roof rafters and in this uncompressed state has an overall width that is somewhat greater than the spacing between the opposing faces of the adjacently disposed roof rafters 11,12. By way of example the distance between the roof rafters is 22.5 inches and the overall width of the panel approximately 23.5 inches. In FIG. 2 the panel is in a compressed state in its final position between the adjacently disposed roof rafters 11, 12. Preferably, a lateral wire or other stiff flexible member such as a fiberglass rod is inserted through grooves formed in the panel for structural stability. It adds stiffness and stability to the panel and aids in keeping the wire from rolling over. The panel 20 in this position has a top face 22 spaced a selected distance downwardly from the lower face of the roof decking 13 and a bottom face 21 facing the open attic space of the building above the attic floor.

Panel 20 is formed from a sheet of aluminum having a preselected thickness of from 0.001 to 0.020 inches, and more preferably in the range of 0.004 to 0.008 inches. The sheet is shaped to provide suitable stiffness making it semi-rigid as well as permitting some compression transverse to its length the latter of which allows squeezing the panel for a press fit between the two adjacently disposed roof rafters. The sheet is stiffened length wise by creases extending lengthwise of the panel and these creases allow one to compress the panel. The creases are shown as accordion-like pleated longitudinal portions 23, 24 proximate respective opposite longitudinal marginal edges of the panel. The pleats include planar narrow strips 27, 28 and 29 where strips 27, 28 are joined by a generally rounded fold 25 and the strips 28, 29 by a rounded reverse fold 26. Other fold arrangements maybe used providing they permit lateral compression of the panel. The undercut groove 31 disposed on each side of the rounded fold 25 provide means for insertion of the longitudinal members or fingers of an installation tool used to snap into place for installation in hard to reach areas.

The outer terminal edge of the outer strip 29 can be rolled upon itself one or more turns defining a curl and providing the panel with a pair of strengthened outer rod-like or tube-like marginal ribs 30. The roll formed edge readily slides on the face of the rafter facilitating inserting the panel between adjacently disposed roof rafters. If desired the panel can be anchored to the roof rafters by fasteners such as tacks, staples or the like passing through, adjacent and/or straddling the rolled edge 30.

The outer strip 29 can for example be disposed at an angle of approximately 45 degrees to the major portion of the sheet located between the according-like pleated marginal portions 23, 24. The pleating permits compressing the panel in a direction transverse to its length an amount sufficient to fit into the spacing between adjacently disposed trusses which as indicated above maybe about 1 inch less than the initial width of the panel before being inserted into position.

Panel 20 has major transverse ribs 32, 33 spaced inwardly a selected distance from respective opposite ends thereof and a plurality of secondary spaced apart ribs 35 disposed there between. Ribs 32, 33 project upwardly toward the lower face of the roof sheeting and ribs 35 project downwardly. The ribs stiffen the central major portion of the panel located between the spaced apart pleated portions 23, 24. Ribs 35 may be used in combination with and/or replaced by other suitably spaced apart panel stiffening protrusions of any suitable shape and/or pattern. Such formations and the bending to form the previously described marginal pleating, i.e. longitudinal creases, can readily be formed by press forming or passing a plain sheet of aluminum between a pair of counter rotating rolls having appropriately mating formations on the surfaces thereof. Another preferred method of producing the panels is by forming the ribs and other features of the panels using a compression die.

Figure 4:
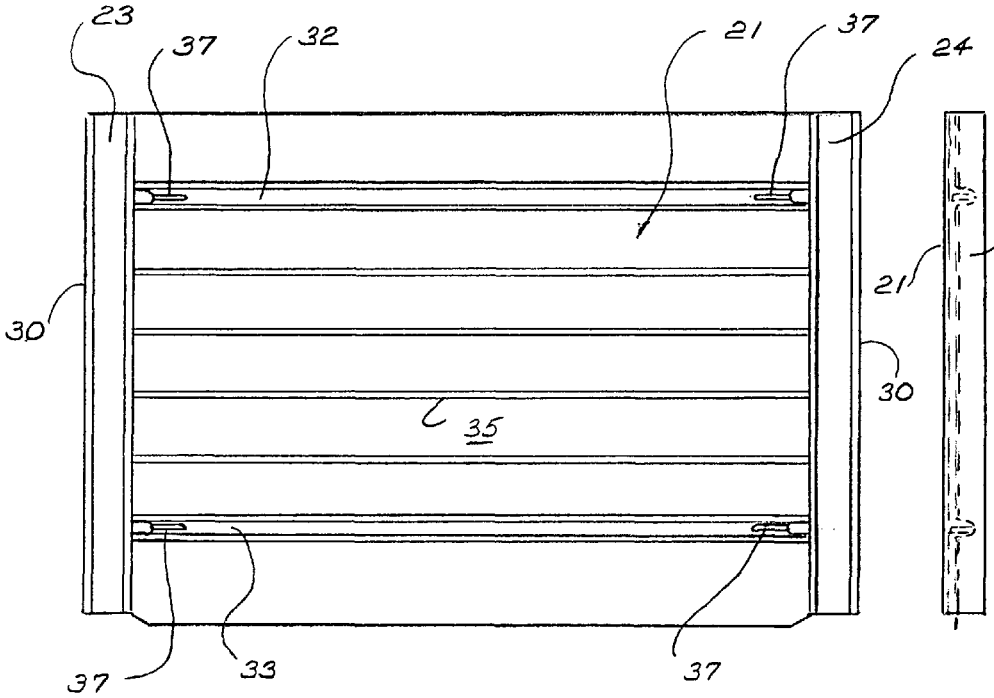
FIG. 4 is a view showing a bottom face of an individual panel.
Figure 5:
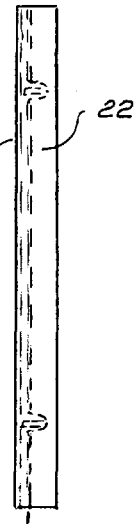
FIG. 5 is a right hand side view of FIG. 4.
Figure 6:
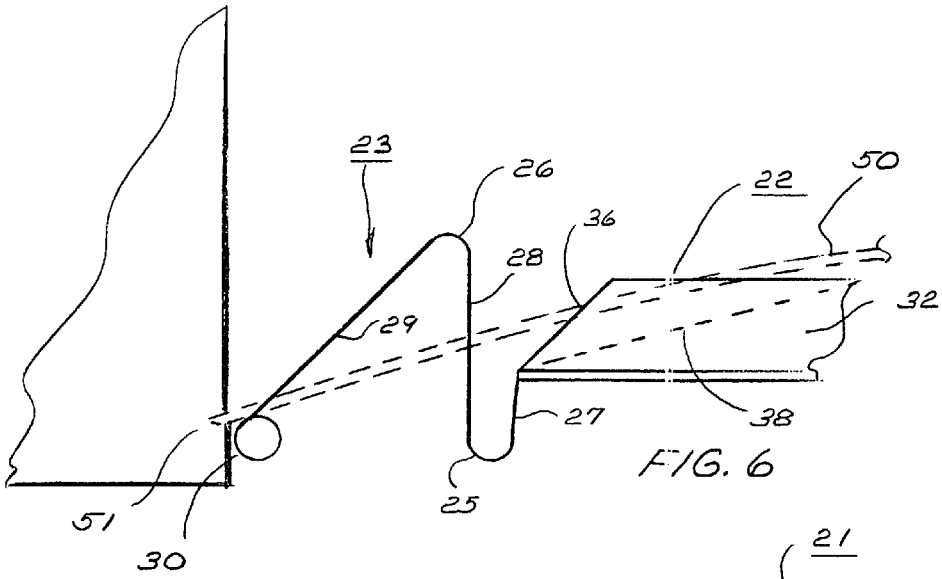
FIG. 6 is an enlarged view of the encircled portion of FIG. 3 but with the rafter omitted.
Figure 7:
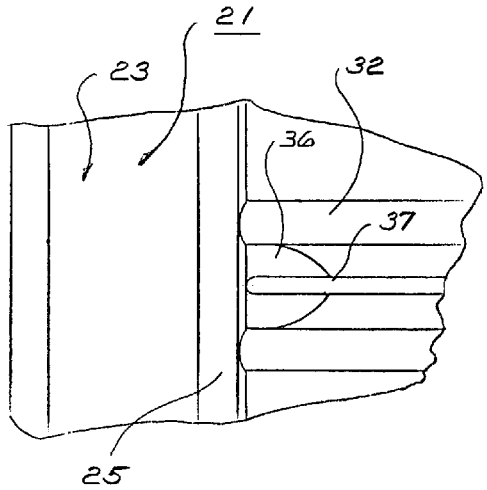
FIG. 7 is a bottom view of FIG. 6.
Figure 8:
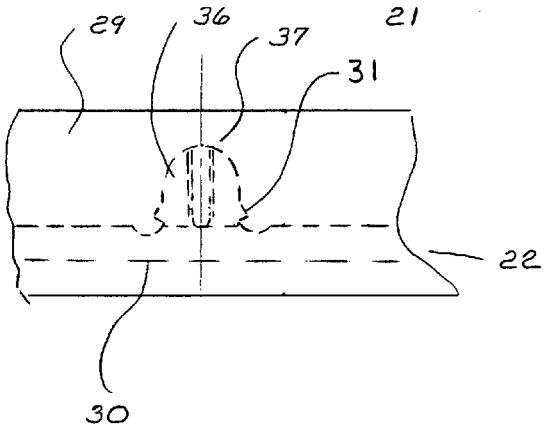
FIG. 8 is a left hand side elevational view of FIG. 6.

FIGS. 6-8 illustrate some details of the panel and referring to these transverse rib 32 has a sloping end portion 36 with a narrow centrally disposed depressed portion providing a groove 37 that has a bottom wall 38. The opposite end of the rib 32 is the same as are the opposite ends of rib 33 as shown in FIG. 4.

The panels are inserted in overlapping series arrangement and extend from the top plate at the soffit to the ridge board in each of the spaces between adjacently disposed roof rafters in the attic of a building. Should moisture in the attic present possible condensation problems then the panels instead of having adjacent ends overlap can be spaced a selected distance from one another providing a gap that allows air in the attic space to mix with the air in the channel above the top face of the panel.

In accordance with a further aspect of the present invention the panel 20 is retained in position between the roof rafters by a pair of arched wire members 50 that provide the dual function of firstly spacing the top face of the panel downwardly a preselected distance from the lower face of the roof decking material and secondly securely anchoring the panels to the roof rafters. Each wire member is springy with an arch of approximately 1.25 inches and a cord length from one to the other of its terminal ends somewhat greater than the distance between the rafters. The terminal ends of the wires are cut at an angle providing a sharp chisel like tip 51 that readily penetrates the surface of the roof rafter and easily punctures through the panel pleats.

Figure 11:
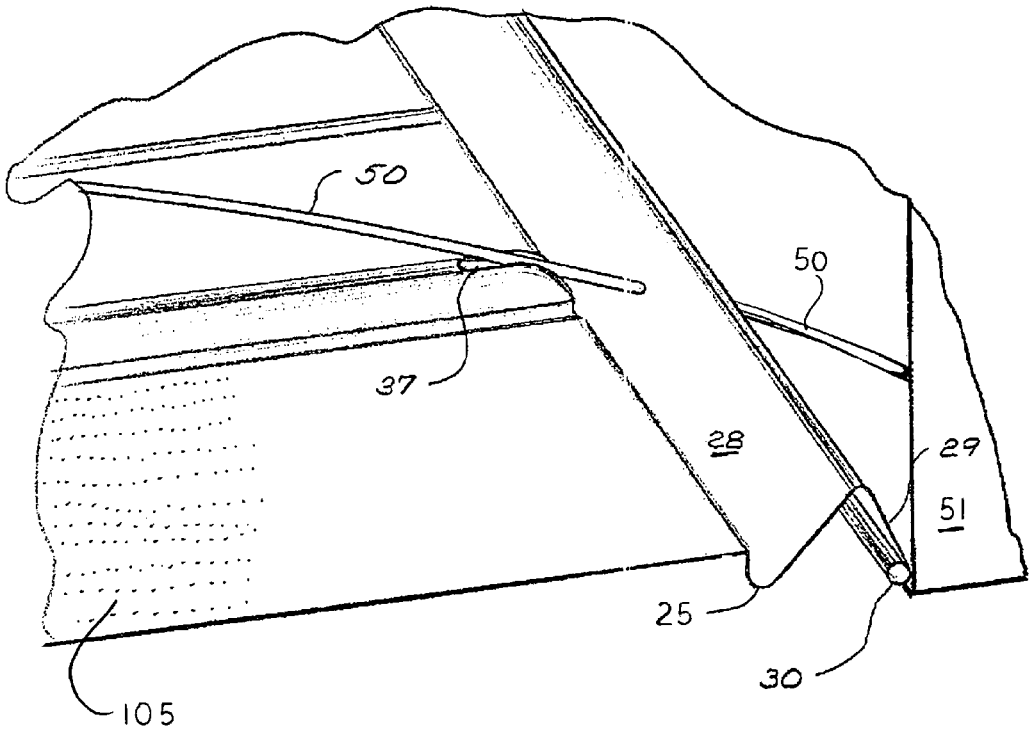
FIG. 11 is a perspective end view of the panel having a lateral wire inserted laterally through lateral grooves formed in the outer ribs of the panel holding the panels stable between a pair of rafters wherein the wires are bowing upward toward the roof and normal to the panel providing means for adjusting the tension of the panels support wire means and preventing the wire from rolling over.

Opposite end portions of the wire pierce through the strips 28, 29 of the creased sections 23 as best illustrated in FIG. 6. The wire rests in the grooves 37 at opposite ends of the transverse rib associated therewith. These grooves stabilize the wires in a position where they are in a plane generally perpendicular to the plane of the central portion of the panel. As shown in FIG. 11 the panel has a lateral wire inserted laterally through lateral grooves formed in the outer ribs of the panel holding the panels stable between a pair of rafters wherein the wires are bowing upward toward the roof and normal to the panel providing means for adjusting the tension of the panels support wire means and preventing the wire from rolling over.

The spacing between the upper face of the panels and the lower face of the roofing deck leaves an open air flow passage 60 from the soffit to vent holes at or near the roof ridge discharging to atmosphere. The depth of such passage is predetermined by the curvature of the wire. If desired the wire instead of having a single curve as shown maybe formed with two or more contiguous curved sections in which case it would have two or more points of contact with the roof decking rather than a single contact point as indicated at 52 in FIG. 3.

Figure 9:
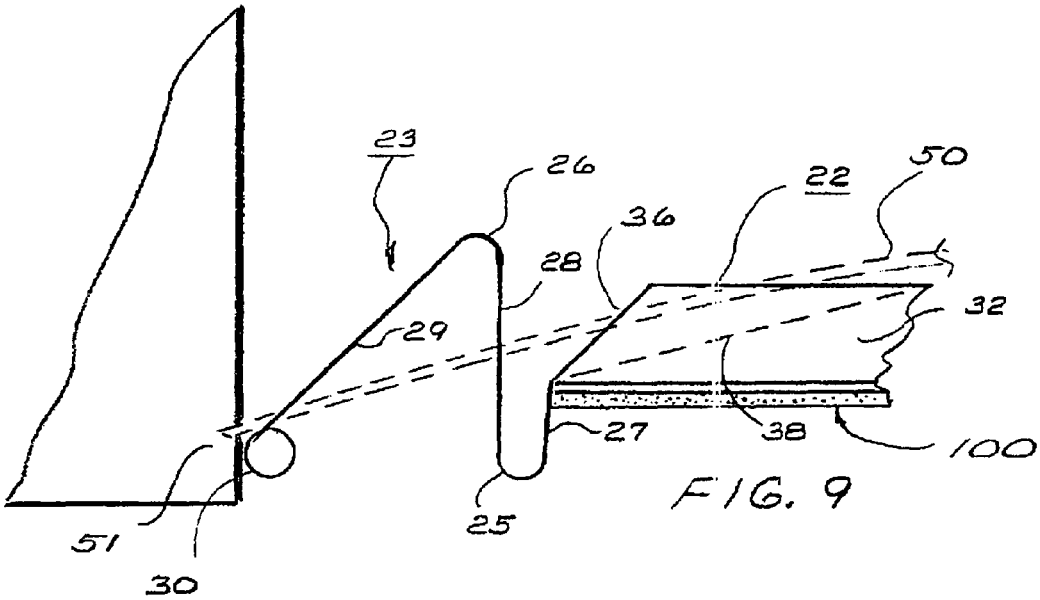
FIG. 9 is an enlarged view of the encircled portion of FIG. 3 but with the rafter omitted showing a thin layer of a sound absorbing material adhering to the bottom of the panel.
Figure 10:
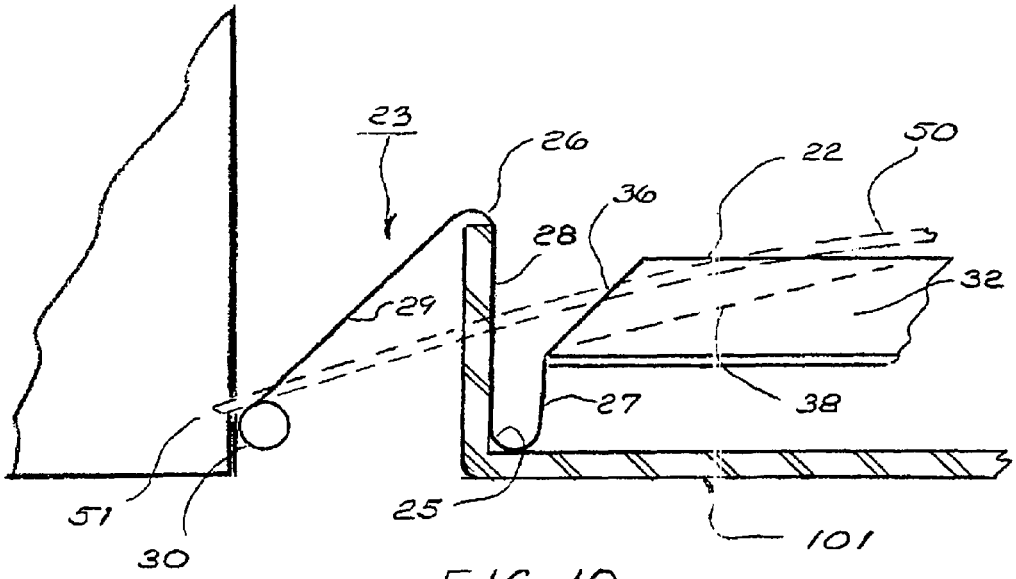
FIG. 10 is an enlarged view of the encircled portion of FIG. 3 but with the rafter omitted showing a layer of an insulating material adhering to the bottom of the panel.

As shown in FIG. 9 a thin layer of a sound absorbing material adheres to the bottom of the panel 10. It is contemplated that a film of a polymer, rubber, closed cell or other foam type material could be used as an insulating material or sound absorbing material. The sound deadening properties are important to achieve good acoustics and filter the sound of rain, etc. in construction projects wherein the roof may not be insulted such as a garage, shop, or barn. FIG. 10 shows a layer of an insulating material adhering to the bottom of the panel.

FIG. 11 illustrates an embodiment of the panel whereof a section of the panel includes perforations 105 which aid in dampening sound and could also provide ventilation depending upon the size of the perforations.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented herein above. Rather, what is intended to be covered is within the spirit and scope of the appended claims.

We claim:

1. A radiant barrier panel spaced a selected distance downwardly from a lower face of a roof, said radiant barrier panel comprising an elongated heat reflective sheet of reflective material of selected thickness having at least one longitudinal creases formed on a selected opposing edge portions thereof permitting compressing the panel a selected amount in a direction transverse to said longitudinal creases and said radiant barrier panel including panel stiffening transverse major ribs spaced apart from one another at selected intervals on the panel including at least one stiff flexible longitudinal lateral support member disposed within said transverse major rib cooperatively engaging said longitudinal creases for cooperatively engaging and removably holding said sheet in a selected position disposed between and biased by and extending to a pair of roof support members comprising rafters.

2. The radiant barrier panel as defined in claim 1 wherein said creases are located proximate each of opposite longitudinal edges of the panel.

3. The radiant barrier panel as defined in claim 2 wherein said major rib extends transversely across the panel from one to the other of said creases at a position proximate each of opposite ends of the panel.

4. The radiant barrier panel as defined in claim 3 including a plurality of minor spaced apart ribs located between said major ribs and disposed between said longitudinal ceases.

5. The radiant barrier panel as defined in claim 1 in which a longitudinal terminal edge of the panel is folded over forming a curl stiffening ribs.

6. The radiant barrier panel as defined in claim 5 wherein a longitudinal terminal edge of said panel is rolled upon itself at least one turn comprising a rolled edge forming a strengthened outer tubular member defining a rod.

7. The radiant barrier panel as defined in claim 1 wherein said major ribs have a narrow groove in each of opposite ends thereof for cooperatively engaging said at least one stiff flexible longitudinal lateral support member.

8. The radiant barrier panel as defined in claim 7 wherein said flexible longitudinal lateral support member comprises a wire for each of said major ribs, said wire having opposite end portions thereof nested in the narrow grooves of the major rib associated therewith and piercing through the longitudinal creases.

9. The radiant barrier panel as defined in claim 1 wherein said longitudinal creases comprise accordion-like parallel pleated sections spaced apart from one another proximate respective opposite longitudinal marginal edges with said pleated sections.

10. A radiant barrier consisting essentially of an elongate radiant heat reflective panel, said panel comprising a sheet of reflective material of selected thickness having one or more longitudinal creases located proximate each of opposite longitudinal edges of the panel permitting compressing the panel a selected amount in a direction transverse to said longitudinal creases and panel stiffening formations spaced apart from one another on the remainder of the panel, said formations including a major rib disposed proximate at least each of opposite ends of the panel and extending transversely across the panel from one to the other of said longitudinal creases and a plurality of minor spaced apart stiffening formations located between said major ribs and said longitudinal creases and each opposing longitudinal edge of the panel is folded upon itself providing a stiffening rib and at least one stiff flexible longitudinal lateral support member disposed within said transverse major rib cooperatively engaging said longitudinal creases for cooperatively engaging and removably holding said sheet in a selected position disposed between and biased by and extending to a pair of roof support members comprising rafters.

11. The radiant barrier panel as defined in claim 10 said at least one stiff flexible longitudinal lateral support member cooperatively engaging and removably holding said sheet in a selected position disposed between a pair of roof support members spaced apart from a roof a selected distance is selected from the group consisting of a wire and a fiberglass rod.

12. The radiant barrier panel as defined in claim 10 wherein said major ribs have a narrow groove in each of opposite ends thereof.

13. The radiant barrier of claim 10, wherein said reflective material comprises a sheet of aluminum.

14. The radiant barrier panel as defined in claim 10 further comprising a least one flexible longitudinal lateral support member cooperatively engaging and removably holding said sheet in a selected position disposed between a pair of roof support members spaced apart from a roof a selected distance.

15. The radiant barrier panel of claim 10, wherein said plurality of minor spaced apart stiffening formations located between said major ribs and said longitudinal creases comprises a plurality of minor spaced apart ribs.

16. The radiant barrier panel as defined in claim 10 wherein a longitudinal terminal edge of said panel is rolled upon itself at least one turn comprising a rolled edge forming a strengthened outer tubular member defining a rod.

17. A radiant barrier comprising a heat reflective elongate panel insertable in friction fit between adjacently disposed spaced apart roof rafters, said panel having first and second laterally spaced apart longitudinally extending creased sections and panel strengthening formations disposed there between, said creased sections being disposed adjacent respective opposite longitudinal marginal edges of the panel permitting compressing the same a selected amount in a direction transverse to said longitudinally extending creased sections and wherein the panel longitudinal marginal edges are formed into panel strengthening ribs, said panel including transverse major ribs spaced apart from one another at selected intervals and at least one stiff flexible longitudinal lateral support member disposed within said transverse major rib cooperatively engaging said longitudinal creases for cooperatively engaging and removably holding said sheet in a selected position disposed between and biased by and extending to a pair of roof support members comprising rafters.

18. The radiant barrier panel of claim 17 wherein said reflective elongate panel comprises a sheet of aluminum.

19. The radiant barrier panel of claim 17, wherein said plurality of minor spaced apart stiffening formations located between said major ribs and said longitudinal creases comprises a plurality of minor spaced apart ribs.

20. The radiant barrier panel as defined in claim 17 wherein a longitudinal terminal edge of said panel is rolled upon itself at least one turn comprising a rolled edge forming a strengthened outer tubular member defining a rod.

* * * * *